US012698118B2

(12) United States Patent
Chang et al.

(10) Patent No.: US 12,698,118 B2
(45) Date of Patent: Aug. 4, 2026

(54) APPARATUS FOR PACKING CONTAINER AND METHOD OF PACKING CONTAINER

(71) Applicant: Samsung Electronics Co., Ltd., Suwon-si (KR)

(72) Inventors: Minseock Chang, Suwon-si (KR); Ilwhan Oh, Seoul (KR); Kibong Roh, Suwon-si (KR)

(73) Assignees: SAMSUNG ELECTRONICS CO., LTD., Gyeonggi-do (KR); NEXTID Co., Ltd., Seoul (KR)

( * ) Notice: Subject to any disclaimer, the term of this patent is extended or adjusted under 35 U.S.C. 154(b) by 221 days.

(21) Appl. No.: 18/408,092

(22) Filed: Jan. 9, 2024

(65) Prior Publication Data

US 2024/0286783 A1 Aug. 29, 2024

(30) Foreign Application Priority Data

Feb. 24, 2023 (KR) ..... 10-2023-0025291
Apr. 27, 2023 (KR) ..... 10-2023-0055658

(51) Int. Cl.
*B65B 51/10* (2006.01)
*B65B 5/02* (2006.01)
(Continued)

(52) U.S. Cl.
CPC ..... *B65B 51/10* (2013.01); *B65B 5/022* (2013.01); *B65B 5/045* (2013.01); *B65B 61/06* (2013.01);
(Continued)

(58) Field of Classification Search
CPC ..... B65B 51/10; B65B 5/022; B65B 5/045; B65B 61/06; B65B 67/1238; B65B 41/16; B65B 2051/105; B65B 2210/04
See application file for complete search history.

(56) References Cited

U.S. PATENT DOCUMENTS 3,522,688 A * 8/1970 Kaliwoda ..... B65B 53/06 53/442
3,621,588 A * 11/1971 Grocke ..... B65B 53/06 53/442
(Continued)

FOREIGN PATENT DOCUMENTS

CN 112455784 A 3/2021
JP 6887490 B2 6/2021
(Continued)

*Primary Examiner* — Dariush Seif
(74) *Attorney, Agent, or Firm* — Muir Patent Law, PLLC

(57) ABSTRACT

A container packaging apparatus according to an embodiment includes a moving table supporting a container, a bag supply unit configured to supply a vinyl bag to cover the container on the moving table, wherein the vinyl bag has a sealed upper part and an opened lower part, a load port including a pair of support blocks that support the bottom surface of the container transferred from the moving table and are spaced apart with a gap through which the vinyl bag passes, and a thermosetting unit configured to form a sealing line on the lower part of the vinyl bag to seal the vinyl bag, the thermosetting unit including a heating block having a heating coil and an elastic pad in contact with the heating block while the vinyl bag is heated by the heating block.

17 Claims, 20 Drawing Sheets

(51) Int. Cl.
*B65B 5/04* (2006.01)
*B65B 41/16* (2006.01)
*B65B 61/06* (2006.01)
*B65B 67/12* (2006.01)

(52) U.S. Cl.
CPC ..... *B65B 67/1238* (2013.01); *B65B 41/16* (2013.01); *B65B 2051/105* (2013.01); *B65B 2210/04* (2013.01)

(56) References Cited

U.S. PATENT DOCUMENTS 3,707,064 A * 12/1972 Mucka ..... B65B 9/135 53/567
3,738,079 A * 6/1973 Rudman ..... B65B 9/135 53/66
3,779,838 A * 12/1973 Wech ..... B29C 66/8181 156/583.1
3,916,148 A * 10/1975 LaFleur ..... B29C 66/91231 493/379
4,064,678 A * 12/1977 Grocke ..... B65B 9/135 53/567
4,233,797 A * 11/1980 Schwarz ..... B65B 9/14 53/66
4,353,196 A * 10/1982 Beer ..... B29C 66/81457 53/51
4,409,774 A * 10/1983 Hannen ..... B65B 9/135 53/64
4,473,990 A * 10/1984 Thimon ..... B65B 9/135 53/442
4,580,391 A * 4/1986 Tetenborg ..... B65B 7/08 53/375.7
4,651,508 A * 3/1987 Hannen ..... B65B 53/066 53/442
4,693,058 A * 9/1987 Kovacs ..... B29C 66/83221 53/371.8
4,706,298 A * 11/1987 Lipes ..... B29C 65/18 156/499
4,866,916 A * 9/1989 Hannen ..... B65B 53/066 53/442
4,971,196 A * 11/1990 Kitamura ..... B32B 27/08 206/718
5,042,235 A * 8/1991 Hannen ..... B65B 53/02 53/442
5,216,871 A * 6/1993 Hannen ..... B65D 71/0096 53/399
5,471,818 A * 12/1995 Hannen ..... B65B 53/066 53/442
5,596,866 A * 1/1997 Martin-Cocher ..... B65B 53/066 53/442
5,806,286 A * 9/1998 Oinuma ..... H10P 72/1911 53/445
5,826,503 A * 10/1998 Hutchinson ..... B29C 66/0042 156/579
6,032,439 A * 3/2000 Birkenfeld ..... B65B 9/135 53/567
6,298,636 B1 * 10/2001 Lachenmeier ..... B65B 9/135 53/442
6,450,088 B1 * 9/2002 Hutchinson ..... B29C 66/828 219/544
6,470,654 B1 * 10/2002 Lachenmeier ..... B65B 9/135 53/461
6,865,865 B2 * 3/2005 Hannen ..... B65B 9/135 53/567
7,200,979 B2 * 4/2007 Hannen ..... B65B 49/04 53/567
7,210,278 B2 * 5/2007 Chiu Chen ..... B65B 9/135 53/64
7,290,382 B2 * 11/2007 Imao ..... B65B 49/08 53/173
7,568,328 B2 * 8/2009 Imao ..... B65B 43/34 53/284.7
7,703,263 B2 * 4/2010 Reiner ..... B65B 53/066 53/442
7,712,290 B2 * 5/2010 Imao ..... B65B 43/26 53/469
7,770,366 B2 * 8/2010 Macleod ..... B65B 9/135 53/511
7,934,361 B2 * 5/2011 Tsuruta ..... B65H 23/1882 53/553
7,966,790 B2 * 6/2011 Michels ..... B65B 9/135 53/556
10,273,031 B2 * 4/2019 Fenn ..... B65B 65/02
10,569,917 B2 * 2/2020 Song ..... B65B 61/20
11,097,860 B2 * 8/2021 Lorenzen ..... B65B 9/135
11,214,023 B2 * 1/2022 Marengo ..... B29C 70/342
2002/0153526 A1 * 10/2002 Toyama ..... H10P 72/1918 257/48
2004/0055258 A1 * 3/2004 Hannen ..... B65B 49/04 53/567
2004/0098949 A1 * 5/2004 Huang ..... H10P 72/1912 53/472
2004/0107677 A1 * 6/2004 Hannen ..... B65B 9/135 53/459
2004/0256373 A1 * 12/2004 Irwin ..... B29C 66/8122 219/243
2006/0288665 A1 * 12/2006 Imao ..... B65B 31/046 53/284.7
2006/0288667 A1 * 12/2006 Imao ..... B65B 49/08 53/570
2006/0288668 A1 * 12/2006 Imao ..... B65B 31/06 53/570
2011/0214778 A1 * 9/2011 Natsume ..... H10P 72/3408 141/369
2011/0258973 A1 * 10/2011 Czok ..... B65B 9/135 53/247
2012/0096814 A1 * 4/2012 Hannen ..... B65B 9/026 53/461
2017/0209295 A1 * 7/2017 Smith ..... B32B 37/02
2022/0348369 A1 * 11/2022 Riethmueller ..... B65B 51/146
2024/0262548 A1 * 8/2024 Konstmann ..... B65B 61/00
2024/0286783 A1 * 8/2024 Chang ..... B65B 5/022
2026/0070722 A1 * 3/2026 Takasugi ..... B65D 75/26

FOREIGN PATENT DOCUMENTS

JP 2023-012191 A 1/2023
KR 10-0725184 B1 6/2007
KR 10-0906294 B1 7/2009
KR 10-1020043 B1 3/2011
KR 10-1194411 B1 10/2012

* cited by examiner

APPARATUS FOR PACKING CONTAINER AND METHOD OF PACKING CONTAINER

CROSS-REFERENCE TO RELATED APPLICATION(S)

This application is based on and claims priority under 35 U.S.C. § 119 to Korean Patent Application No. 10-2023-0025291, filed on Feb. 24, 2023, and 10-2023-0055658, filed on Apr. 27, 2023, in the Korean Intellectual Property Office, the disclosure of each of which is incorporated by reference herein in its entirety.

BACKGROUND

The inventive concept relates to a container packaging apparatus and a container packaging method, and more particularly, to a container packaging apparatus configured to wrap a container with a vinyl member and a container packaging method using the container packaging apparatus.

In order to manufacture a semiconductor device, various semiconductor processes such as development, exposure, and cleaning are performed on a wafer. At this time, in order to efficiently manufacture semiconductor devices, various semiconductor processes may be performed by a plurality of manufacturing facilities deployed in different locations. When manufacturing a semiconductor device, a wafer may be transferred in a container between a plurality of manufacturing facilities. At this time, in order to prevent the wafer from being contaminated, various attempts have been made to block the wafer from external environments during transfer of the wafer.

SUMMARY

The inventive concept provides a container packaging apparatus having sealing reliability.

The inventive concept provides a method of packaging a container so as to improve sealing reliability.

According to an aspect of the inventive concept, there is provided a container packaging apparatus includes a moving table supporting a container, a bag supply unit configured to supply a vinyl bag to cover the container on the moving table, wherein the vinyl bag has a sealed upper part and an opened lower part, a load port including a pair of support blocks that support a bottom surface of the container transferred from the moving table and are spaced apart with a gap through which the vinyl bag passes, and a thermosetting unit configured to form a sealing line on the lower part of the vinyl bag to seal the vinyl bag, the thermosetting unit including a heating block having a heating coil and an elastic pad in contact with the heating block while the vinyl bag is heated by the heating block, wherein a number of windings per unit length of the heating coil at an edge of the heating block is greater than a number of windings per unit length of the heating coil at the center of the heating block, wherein a thickness of the vinyl bag is in a range from about 0.03 mm to about 0.05 mm, wherein a thickness of the elastic pad is in a range from about 3 mm to about 7 mm, and wherein the pair of support blocks respectively support one side and another side of the bottom surface of the container.

According to another aspect of the inventive concept, there is provided a container packaging apparatus includes a load port including a pair of support blocks that support a container covered with a vinyl bag and are spaced apart from each other with a gap through which the vinyl bag passes, and a thermosetting unit configured to form a sealing line under the vinyl bag and including a heating block having a heating coil and an elastic pad contacting the heating block while the vinyl bag is heated by the heating block, wherein a number of windings per unit length of the heating coil at an edge of the heating block is greater than a number of windings per unit length of the heating coil at a center of the heating block, wherein the pair of support blocks respectively support one side and another side of the bottom surface of the container, and wherein the pair of support blocks are each a single piece.

According to an aspect of the inventive concept, there is provided a method of packing a container, the method includes mounting the container on a moving table, covering the container mounted on the moving table with a vinyl bag including a sealed upper part and an opened lower part, transferring the container covered with the vinyl bag onto a load port, and forming a sealing line on the lower part of the vinyl bag by heating the vinyl bag with the heating block after fixing the vinyl bag between a heating block and an elastic pad, wherein a thickness of the vinyl bag is in a range from about 0.03 mm to about 0.05 mm, and wherein a thickness of the elastic pad is in a range from about 3 mm to about 7 mm.

BRIEF DESCRIPTION OF THE DRAWINGS

Embodiments will be more clearly understood from the following detailed description taken in conjunction with the accompanying drawings in which.

DETAILED DESCRIPTION OF THE EMBODIMENTS

Figure 1A:
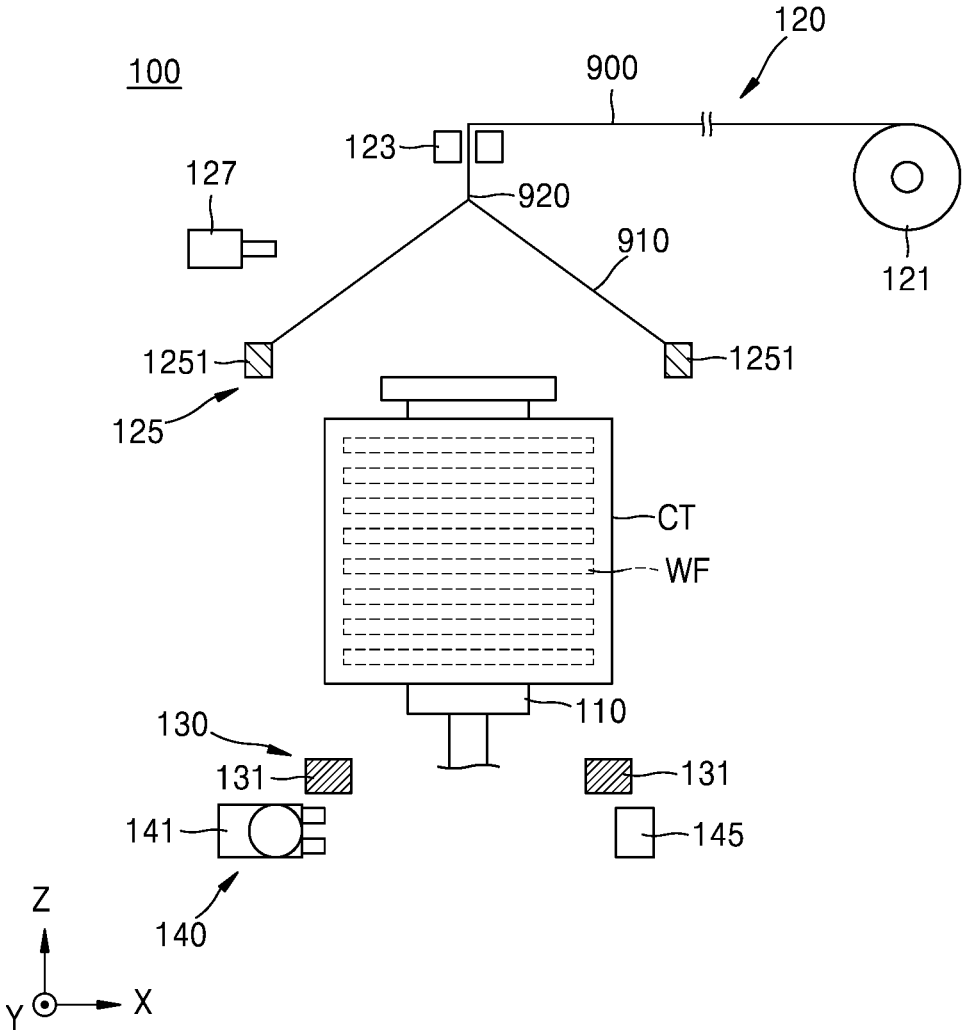
FIGS. 1A to 1F are configuration diagrams illustrating a container packaging apparatus according to example embodiments.

Hereinafter, embodiments of the technical idea of the inventive concept will be described in detail with reference to the accompanying drawings. Like reference numerals are used for like elements in the drawings, and duplicate descriptions thereof are omitted.

In the specification, the vertical direction may be defined as a Z direction, and a horizontal direction may be defined as a direction perpendicular to the Z direction. A first horizontal direction and a second horizontal direction may be perpendicular to each other, the first horizontal direction may be referred to as an X direction, and the second horizontal direction may be referred to as a Y direction. A vertical level may denote a position in the vertical direction.

FIGS. 1A to 1F are configuration diagrams illustrating a container packaging apparatus according to example embodiments. FIGS. 2A to 2D are diagrams showing vinyl fabric 900 and a vinyl bag 910 separated from the vinyl fabric 900, FIG. 2A is a schematic diagram showing the vinyl fabric 900, FIG. 2B is a schematic diagram showing a state in which the vinyl fabric 900 is cut into a plurality of vinyl bags 910, FIG. 2C is a perspective view showing the vinyl bag 910 covering a container CT before a heat fusion treatment, and FIG. 2D is a perspective view showing the vinyl bag 910 covering the container CT after the heat fusion treatment.

Referring to FIGS. 1A to 1E and 2A to 2D, the container packaging apparatus 100 may be configured to wrap the container CT with a vinyl member. When packaging of the container CT using the container packaging apparatus 100 is completed, the container CT is sealed by a vinyl member, and the container CT may be blocked from external air by the vinyl member. The vinyl member may be, for example, a vinyl bag 910.

The container CT may be configured to accommodate a substrate WF for manufacturing a semiconductor device. For example, the container CT may include any one of a sealed container such as a front open unified pod (FOUP) configured to accommodate a plurality of substrates WF, a magazine configured to accommodate a plurality of substrates WF, and a tray configured to accommodate a plurality of substrates WF.

The container packaging apparatus 100 may include a moving table 110, a bag supply unit 120, a load port 130, and a thermosetting unit 140.

The moving table 110 may support the container CT. The moving table 110 may contact and support the central portion of a bottom surface of the container CT. The moving table 110 is configured to move in the vertical direction (Z direction) and the horizontal directions, and the movement of the moving table 110 may be controlled by an actuator connected to the moving table 110. The moving table 110 supports the container CT mounted on its mounting surface and may also transfer the container CT. For example, the container CT brought into the container packaging apparatus 100 from the outside is loaded on the moving table 110, and the moving table 110 may move the container CT that has undergone a series of processes above the load port 130.

The bag supply unit 120 may supply a vinyl bag 910 to cover the container CT mounted on the moving table 110. The vinyl bag 910 may have a shape and size suitable for sealing the container CT and may have a bag shape providing an internal space suitable for packaging the container CT. The vinyl bag 910 may include, for example, polyethylene or high density polyethylene (HDPE). The vinyl bag 910 provided from the bag supply unit 120 may have an upper part and a lower part, and the upper part may be closed or sealed, and the lower part may be opened. For example, an upper part of the vinyl bag 910 may have an upper bonding line 920 formed by bonding two surfaces, and a lower part of the vinyl bag 910 may have an opening 940. The lower part of the vinyl bag 910 may be sealed by a heat fusion process using the thermosetting unit 140 to be described below.

In embodiments, the bag supply unit 120 may include a supply roll 121, a guide roll 123, a holder 125, and a cutter 127.

The supply roll 121 may supply the vinyl fabric 900. The vinyl fabric 900 may be wound around the supply roll 121, and the supply roll 121 may transfer the vinyl fabric 900 along a predetermined path through winding and rewinding. The guide roll 123 is disposed on a transfer path of the vinyl fabric 900, and may guide the transfer of the vinyl fabric 900.

The holder 125 holds the end of the vinyl fabric 900 and moves while holding the end of the vinyl fabric 900 to move the vinyl fabric 900. The holder 125 may include a plurality of holding blocks 1251 configured to hold one side and another side of the end of the vinyl fabric 900, and each of the plurality of holding blocks 1251 may be configured to be moved in the horizontal direction and/or the vertical direction (Z direction) by an actuator. For example, the holder 125 may include two holding blocks 1251 spaced apart in the first horizontal direction (X direction), and each of the two holding blocks 1251 may have a bar shape linearly extending in the second horizontal direction (Y direction) in a plan view. One of the two holding blocks 1251 may hold one side of the end of the vinyl fabric 900, and the other of the two holding blocks 1251 may hold another side of the end of the vinyl fabric 900. As the two holding blocks 1251 hold one side and another side of the end of the vinyl fabric 900, the end of the vinyl fabric 900 may be deformed into a square shape.

The cutter 127 may cut the vinyl fabric 900. The cutter 127 may separate the vinyl bag 910 from the vinyl fabric 900 by cutting the vinyl fabric 900. The cutter 127 may cut the vinyl fabric 900 along the cutting lines 951.

The vinyl fabric 900 may include a plurality of upper bonding lines 920 separated from each other in a length direction of the vinyl fabric 900. Referring to FIG. 2A, each of the upper bonding lines 920 extends in the width direction of the vinyl fabric 900 and may extend from one side to another side of the vinyl fabric 900. The vinyl fabric 900 may include a plurality of segments spaced apart from each other by the plurality of upper bonding lines 920, and each of the plurality of segments of the vinyl fabric 900 may have a closed space. Each of the plurality of segments of the vinyl fabric 900 may constitute one vinyl bag 910. More specifically, when the cutter 127 cuts the vinyl fabric 900 along the cutting lines 951, each of the plurality of vinyl bags 910 may be separated from the vinyl fabric 900. Each vinyl bag 910 may have an upper part sealed by the upper bonding line 920 and an opened lower part.

The load port 130 may support the container CT as it is transferred to the moving table 110. After the process of covering the container CT mounted on the moving table 110 with the vinyl bag 910 is completed, the moving table 110 may transfer the container CT covered with the vinyl bag 910 to the load port 130. After transferring the container CT to the load port 130, the moving table 110 may be moved away from the container CT. The load port 130 may include a pair of support blocks 131 spaced apart from each other.

The pair of support blocks 131 may be spaced apart in the first horizontal direction (X direction), and each pair of support blocks 131 may extend in the second horizontal direction (Y direction). The pair of support blocks 131 may be configured to be moved by an actuator. The pair of support blocks 131 may respectively support one side and another side of a bottom surface of the container CT. For example, the pair of support blocks 131 may be provided at opposite ends of the bottom surface of the container CT to support the container CT. When the container CT is mounted on the pair of support blocks 131, a portion of the vinyl bag 910 may pass through a gap or space between the pair of support blocks 131 and exit to a lower side of the pair of support blocks 131. In addition, when the container CT is mounted on the pair of support blocks 131, a portion of the vinyl bag 910 may extend between each of the pair of support blocks 131 and the container CT.

The pair of support blocks 131 may have a symmetrical shape. The pair of support blocks 131 may have mirror symmetry with respect to an arbitrary reference plane (e.g., a YZ plane). The pair of support blocks 131 may each be a single piece, and the pair of support blocks 131 may have the same material composition as each other. If one side of the bottom surface of the container CT is supported by a plurality of blocks, there may be a problem that a vinyl member may be torn due to friction between the plurality of blocks and the vinyl member between the plurality of blocks. However, according to embodiments, because one side of the bottom surface of the container CT is supported by one support block 131 having a single piece structure, the problem such as tearing of the vinyl bag 910 may be reduced.

Each of the pair of support blocks 131 may include polyethylene. In example embodiments, each of the pair of support blocks 131 may include ultra high molecular weight polyethylene (UHMW-PE).

The thermosetting unit 140 may perform a thermosetting process on a lower part of the vinyl bag 910 so that the vinyl bag 910 has a closed lower part. When the thermosetting process is completed, a sealing line 930 extending in the width direction of the vinyl bag 910 may be formed at the lower part of the vinyl bag 910. The sealing line 930 may be formed by fusing two surfaces of the vinyl bag 910 into one line. When the thermosetting process is completed, the upper part of the vinyl bag 910 may be sealed by the upper bonding line 920, and the lower part of the vinyl bag 910 may be sealed by the sealing line 930, and thus, the vinyl bag 910 may have an airtight space in which the container CT is accommodated.

The thermosetting unit 140 may include a heating block 141 and an elastic pad 145. The heating block 141 and the elastic pad 145 may be respectively disposed below the pair of support blocks 131 supporting the container CT. The heating block 141 may include a heating coil 1417 (refer to FIG. 8), which is an electrical resistance heating element. The heating block 141 and the elastic pad 145 may be spaced apart in the first horizontal direction (X direction), and the heating block 141 and the elastic pad 145 may each extend in the second horizontal direction (Y direction). At least one of the heating block 141 and the elastic pad 145 may be moved in the vertical direction (Z direction) and/or the horizontal direction by an actuator. A distance in the first horizontal direction (X direction) between the heating block 141 and the elastic pad 145 may be adjusted by moving at least one of the heating block 141 and the elastic pad 145. In order to form a sealing line 930 at the bottom of the vinyl bag 910, operations of close contacting the heating block 141 to one surface of the elastic pad 145, heating the vinyl bag 910 disposed between the heating block 141 and the elastic pad 145 at a predetermined time and temperature with the heating block 141, and separating the heating block 141 and the elastic pad 145 may be performed.

Figure 2A:
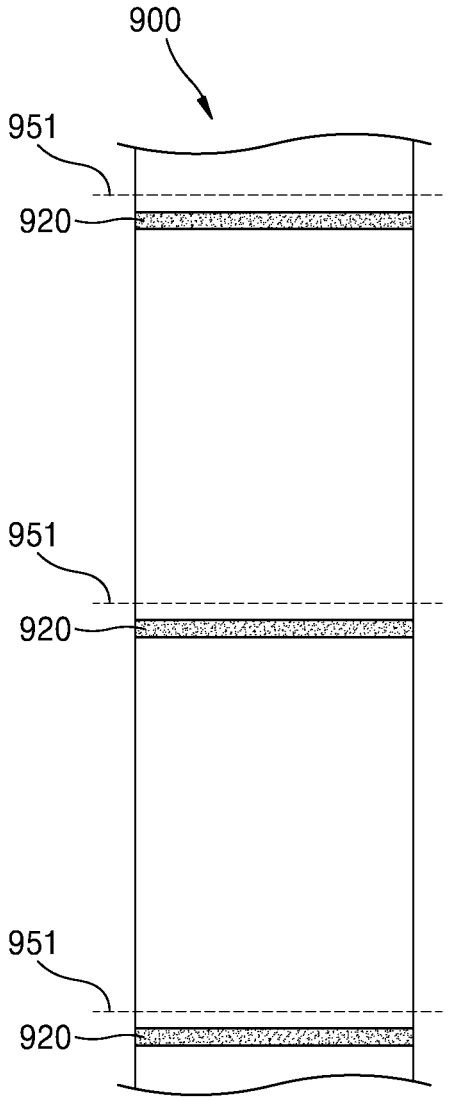
FIGS. 2A to 2D are diagrams showing a vinyl fabric and a vinyl bag separated from the vinyl fabric according to example embodiments.
Figure 2B:
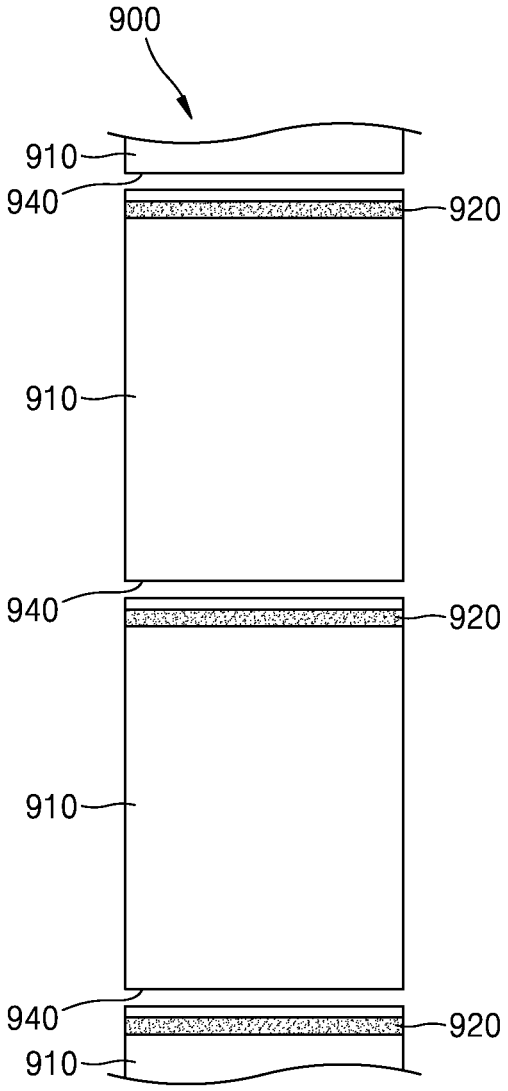
Figure 3:
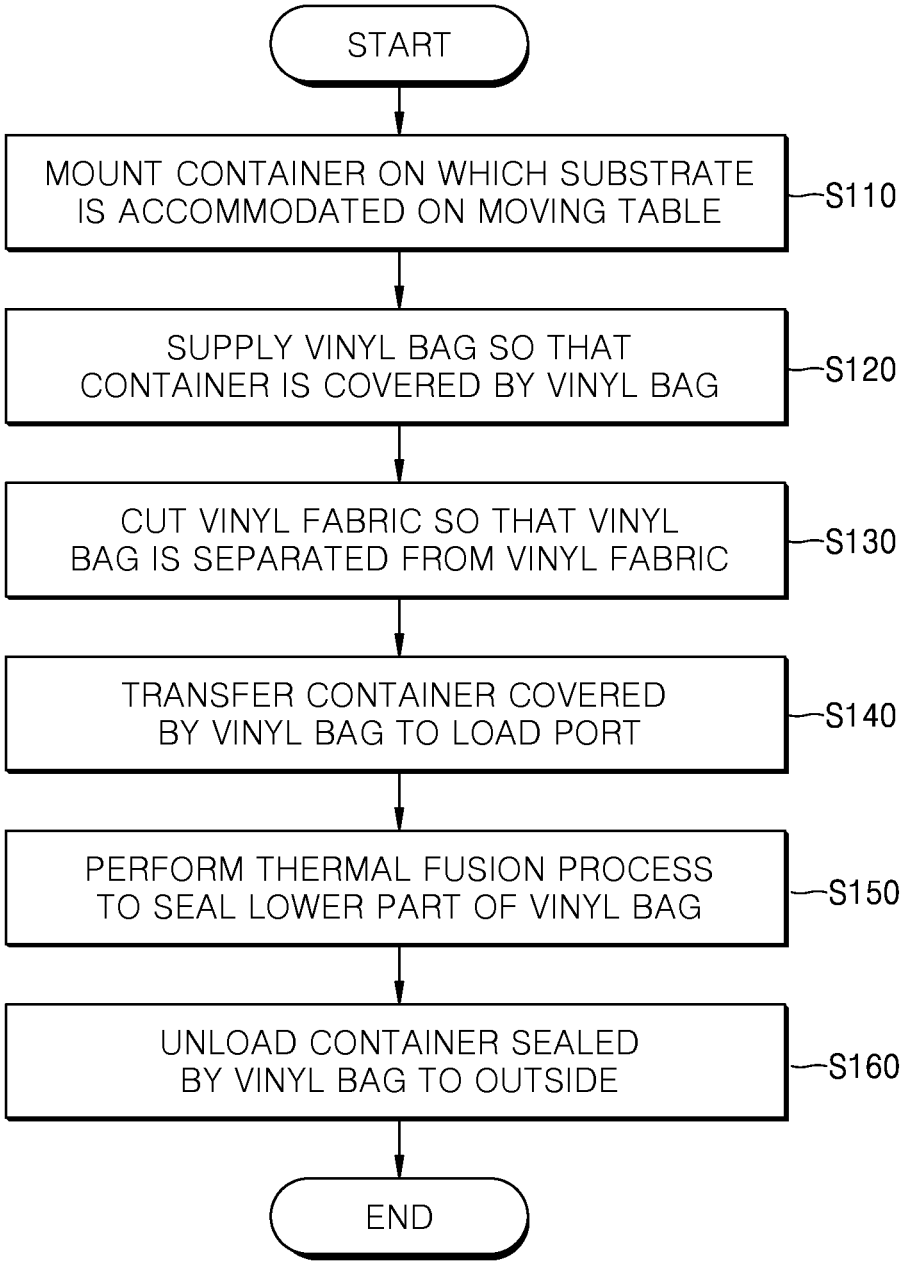
FIG. 3 is a flowchart illustrating a container packaging method according to example embodiments.

FIG. 3 is a flowchart illustrating a container packaging method according to example embodiments. Hereinafter, a container packaging method using the container packaging apparatus 100 is described with reference to FIGS. 1A to 1F, FIGS. 2A and 2B, and FIG. 3.

Figure 2C:
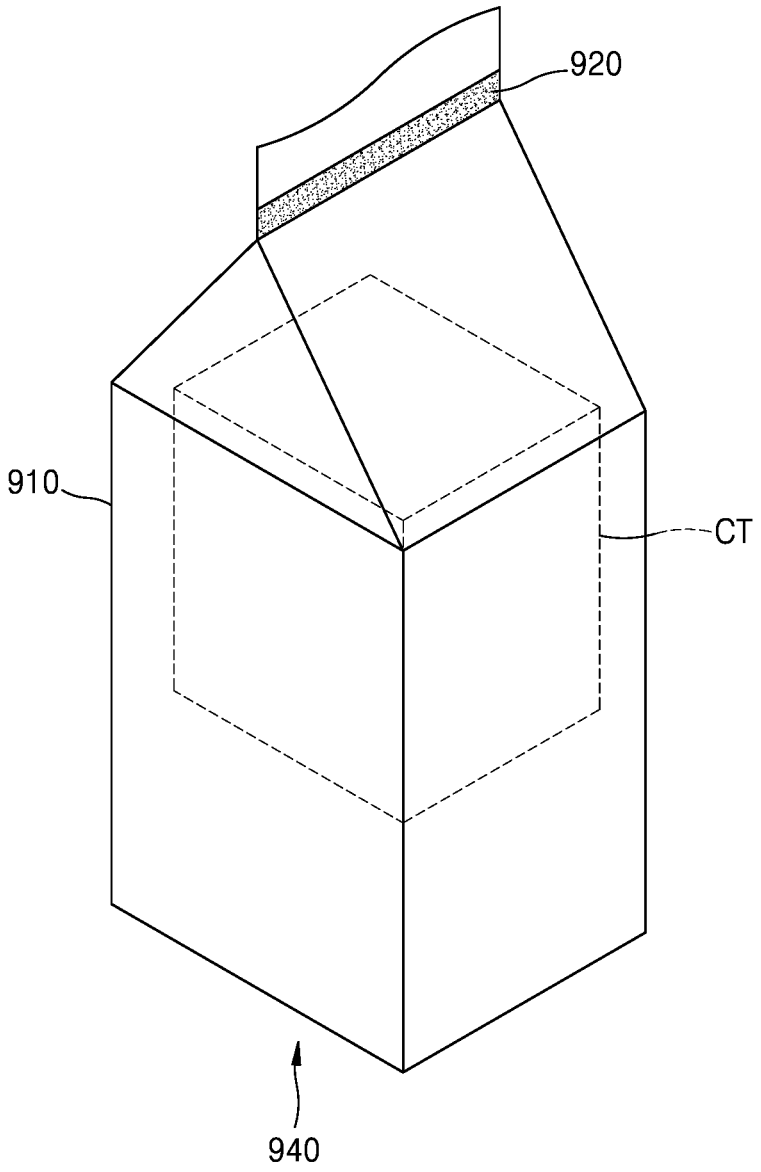
Figure 2D:
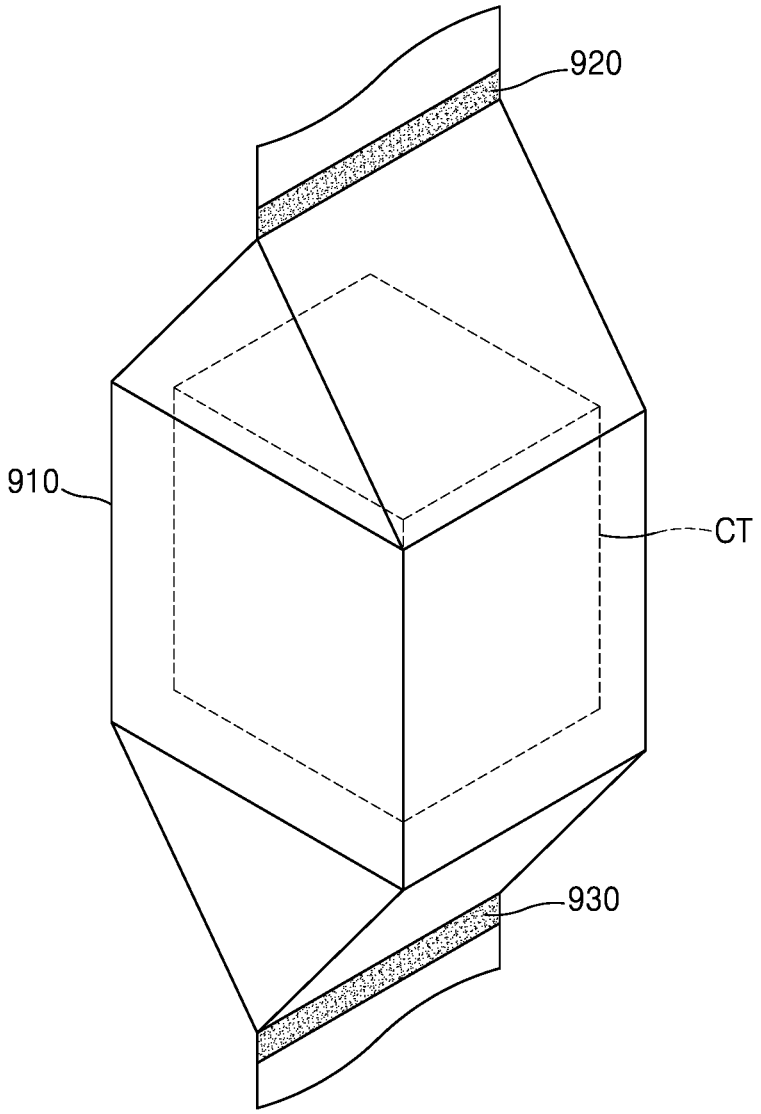

Referring to FIG. 1A, a container CT in which a substrate WF is accommodated is loaded into the container packaging apparatus 100, and the loaded container CT is mounted on the moving table 110 (S110). The moving table 110 may support the central portion of a bottom surface of the container CT.

Figure 1B:
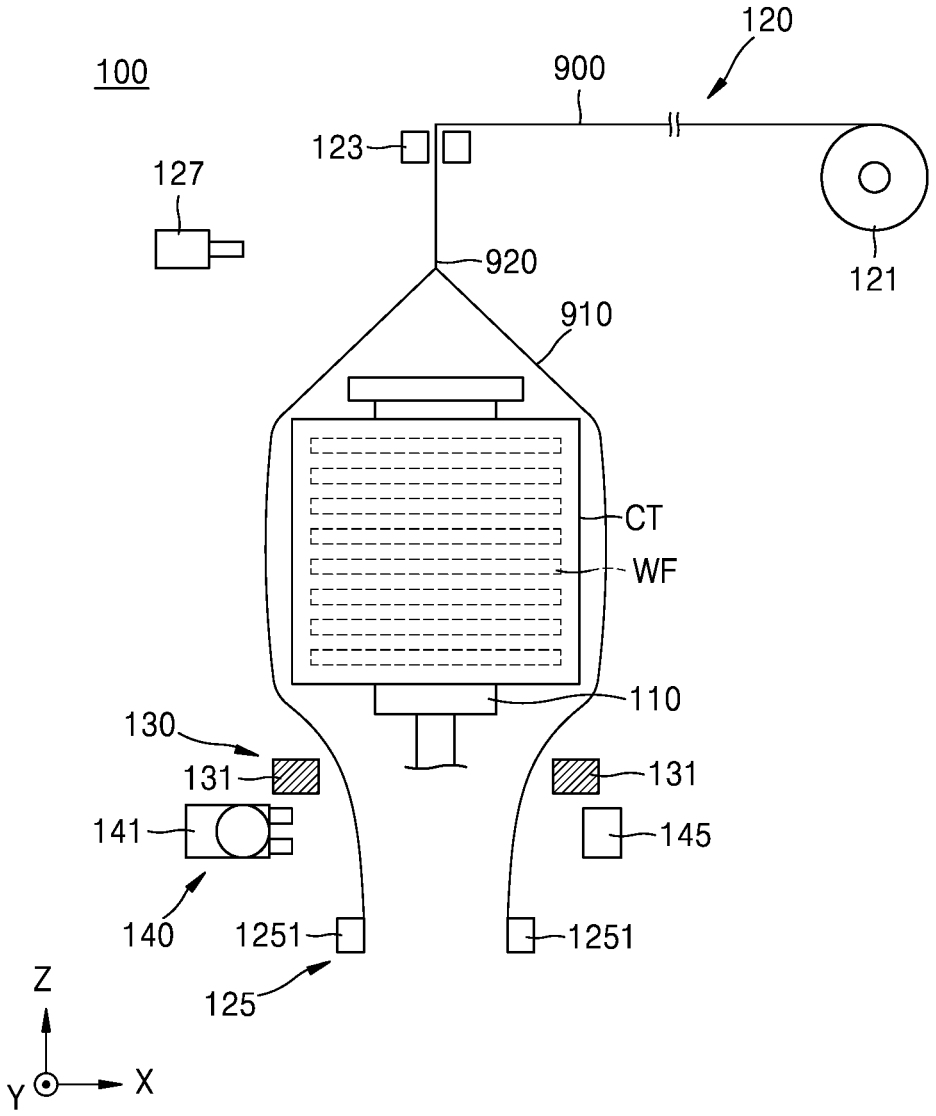

Referring to FIGS. 1A and 1B, after the container CT is mounted on the moving table 110, the vinyl bag 910 is supplied so that the container CT mounted on the moving table 110 is covered with the vinyl bag 910 (S120). The holding blocks 1251 of the holder 125 hold the end of the vinyl fabric 900 that is provided by the supply roll 121. When the holding blocks 1251 spaced apart in the first horizontal direction (X direction) hold one side and another side of the end of the vinyl fabric 900, the end of the vinyl fabric 900 may be deformed into a square shape. After holding the end of the vinyl fabric 900 provided by the supply roll 121 with the holding blocks 1251, the holding blocks 1251 may be moved downwards so that the sides of the container CT are surrounded by the vinyl bag 910.

Figure 1C:
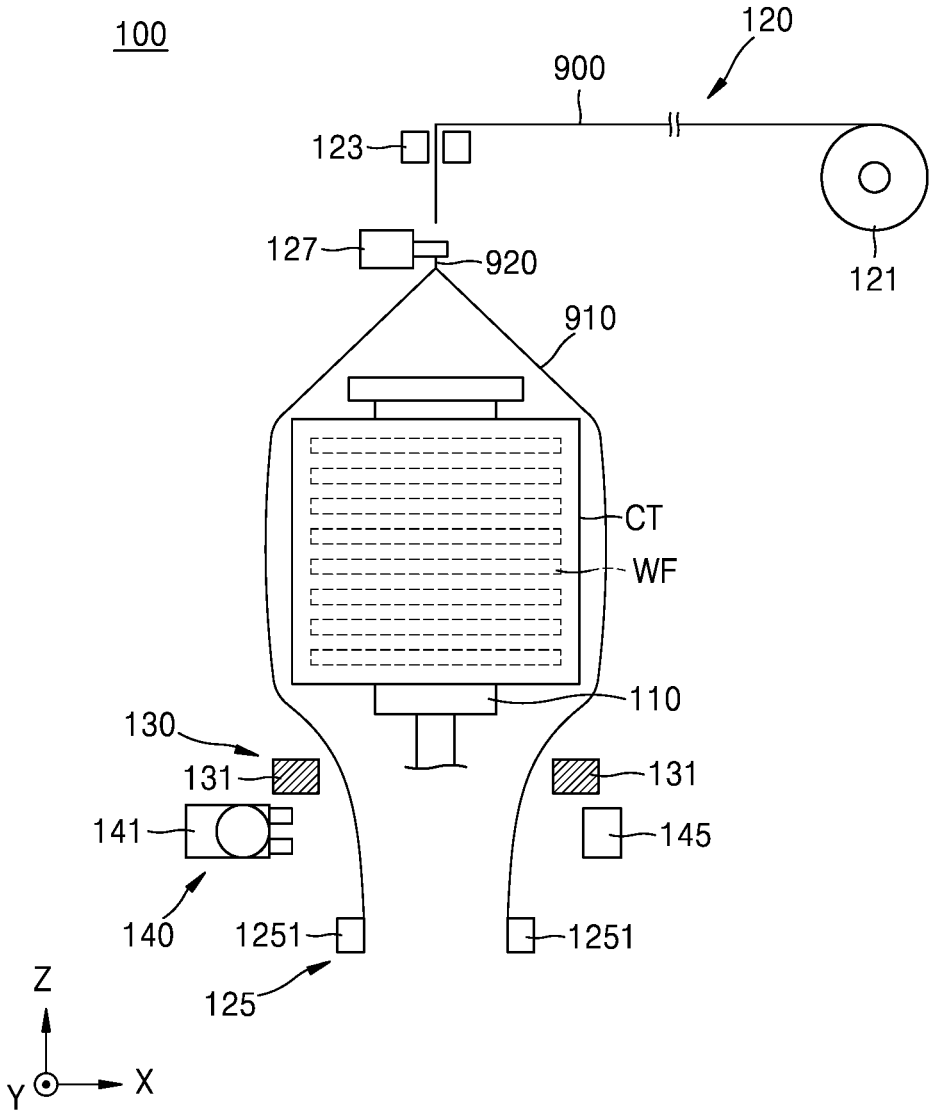

Referring to FIG. 1C, the vinyl fabric 900 is cut along the cutting line 951 so that the vinyl bag 910 is separated from the vinyl fabric 900 (S130). The cutter 127 may separate the vinyl bag 910 from the vinyl fabric 900 by cutting the vinyl fabric 900 while moving along the cutting line on an upper side of the bonding line 920.

Figure 1D:
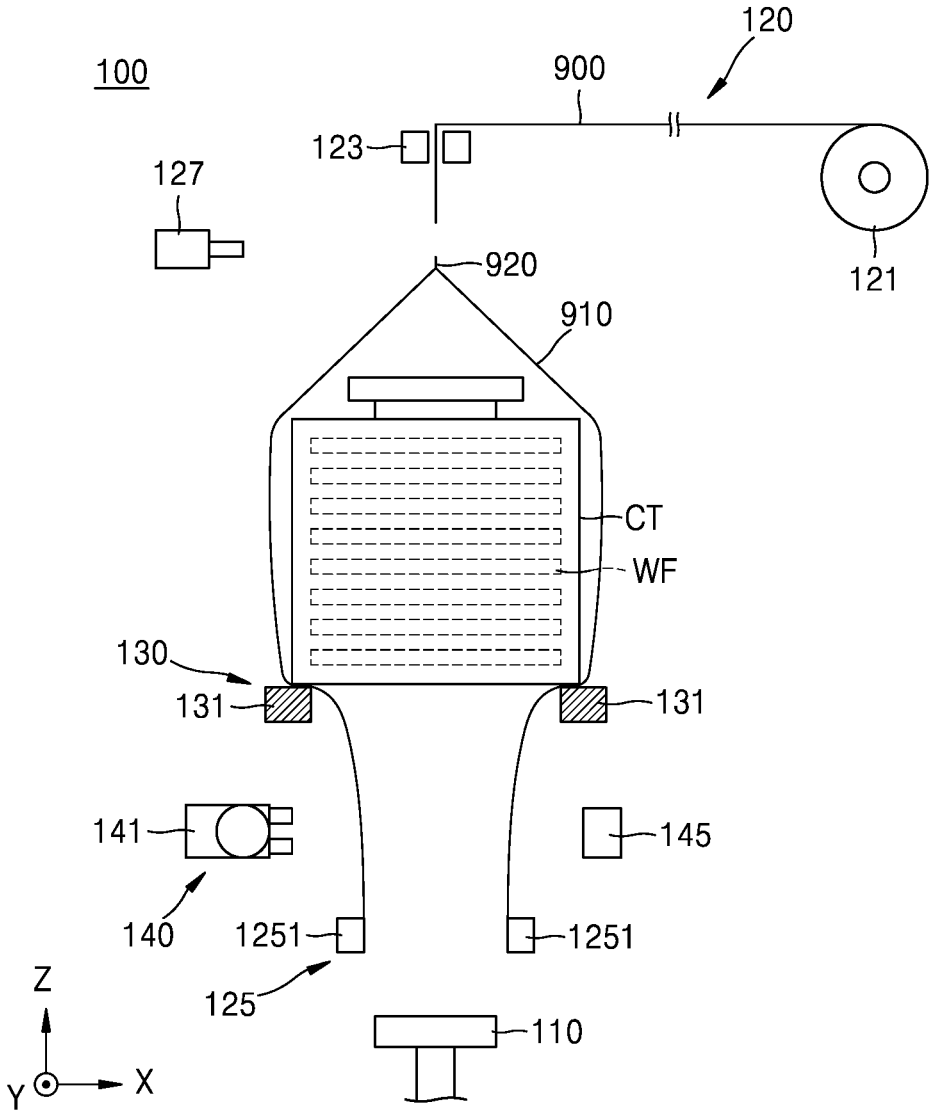

Referring to FIG. 1D, the container CT covered with the vinyl bag 910 is transferred to the load port 130 (S140). After transferring the container CT so that the container CT is seated on the pair of support blocks 131, the moving table 110 may move in a direction away from the container CT. A portion of a bottom surface of the container CT that is in contact with and supported by the moving table 110 may not overlap with portions of a bottom surface of the container CT that are in contact with and supported by the pair of support blocks 131. A portion of the vinyl bag 910 may pass below the pair of support blocks 131 through a gap between the pair of support blocks 131.

Figure 1E:
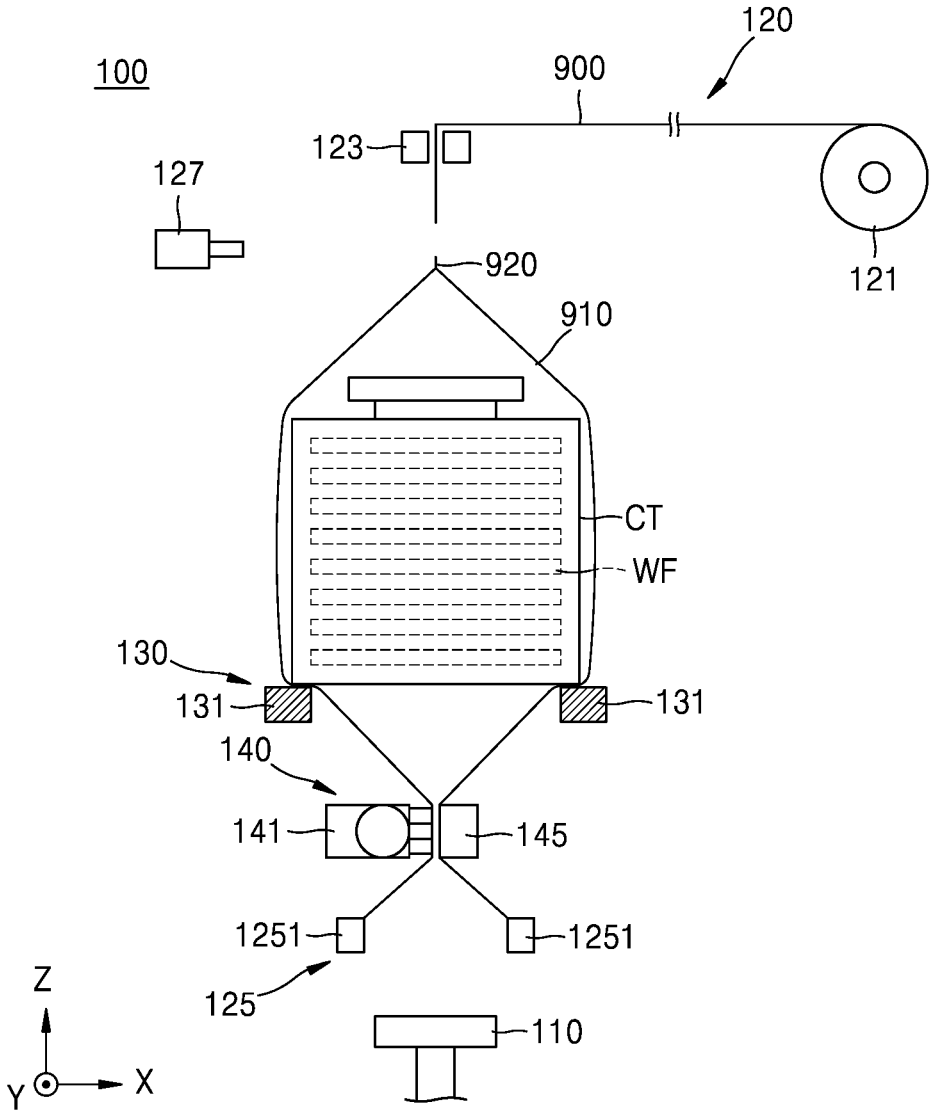
Figure 1F:
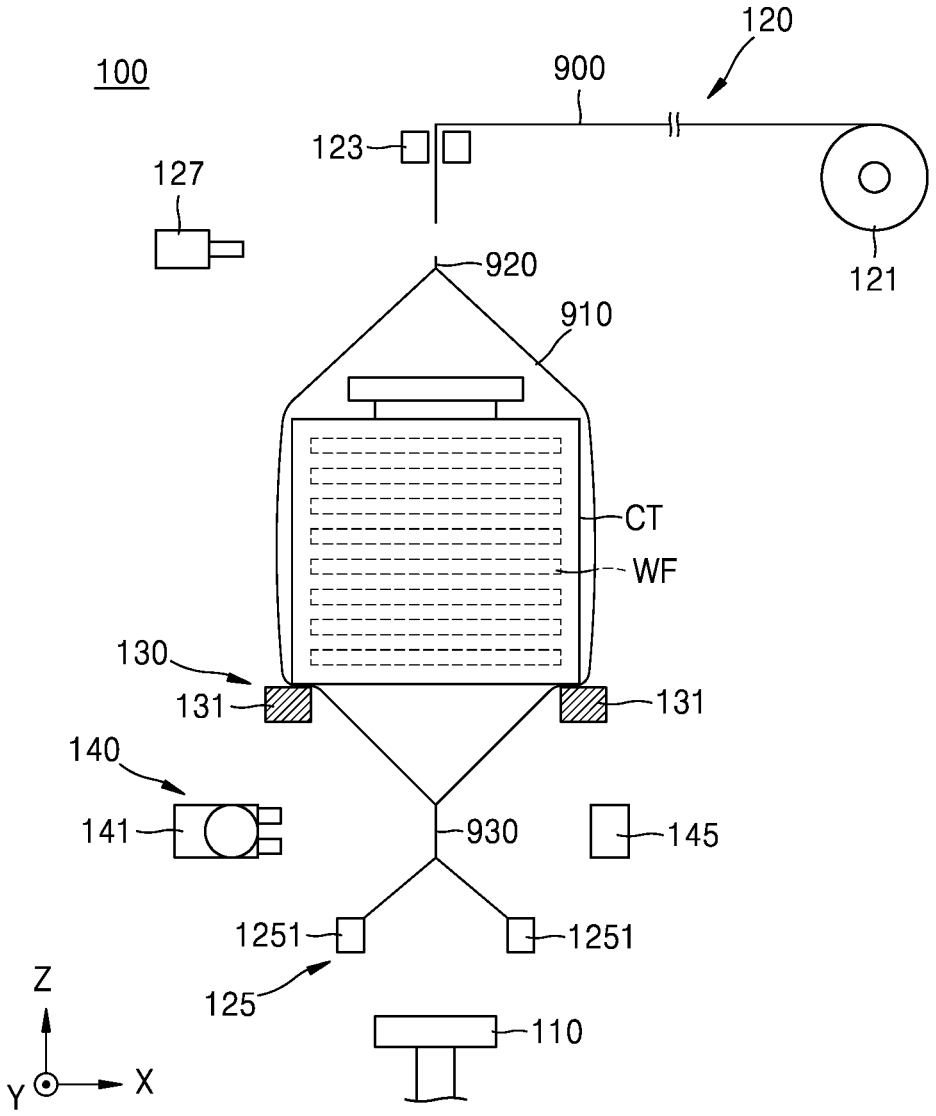

Referring to FIGS. 1E and 1F, a thermosetting process is performed to seal the bottom of the vinyl bag 910 (S150). In order to form the sealing line 930 under the vinyl bag 910, operations of fixing the vinyl bag 910 between the heating block 141 and the elastic pad 145 by bringing the heating block 141 into close contact with one surface of the elastic pad 145, heating the vinyl bag 910 interposed between the heating block 141 and the elastic pad 145 at a predetermined time and temperature with the heating block 141, and separating the heating block 141 and the elastic pad 145 may be performed. When the thermal sealing process is completed, as shown in FIG. 2D, an upper part of the vinyl bag 910 may be sealed by a bonding line 920 and a lower part of the vinyl bag 910 may be sealed by a sealing line 930, and accordingly, the vinyl bag 910 may have an airtight space in which the container CT is accommodated.

Next, the container CT sealed by the vinyl bag 910 is unloaded to the outside of the container packaging apparatus 100 (S160).

Figure 4:
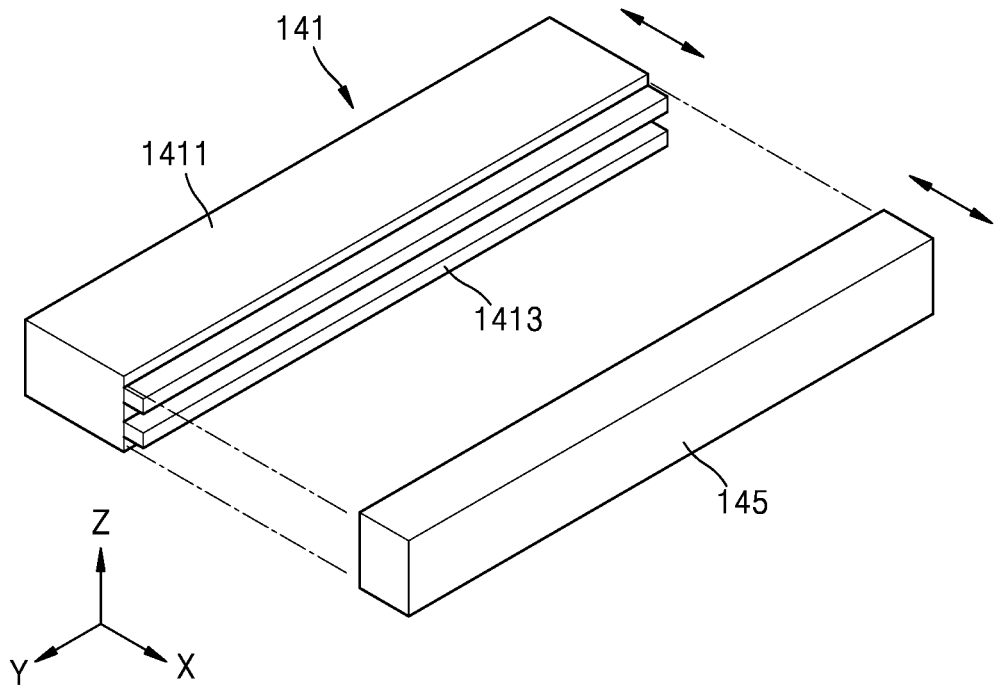
FIG. 4 is a perspective view illustrating a thermosetting unit according to example embodiments.
Figure 5:
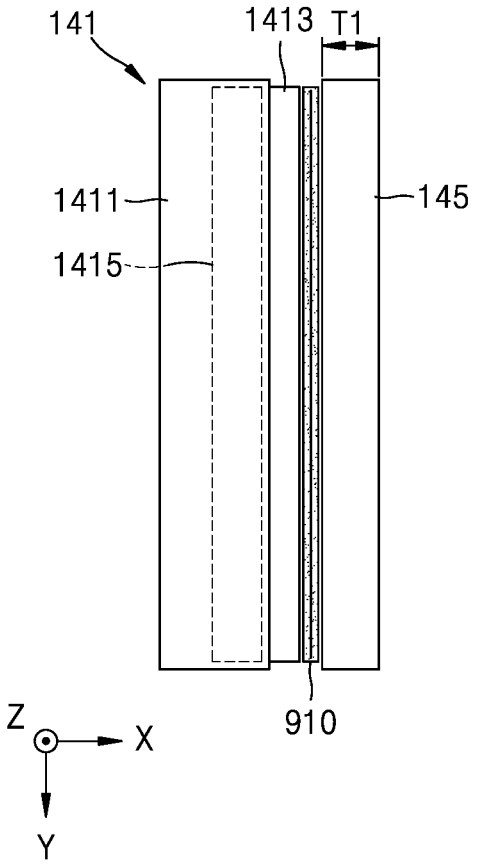
FIG. 5 is a plan view of a thermosetting unit according to example embodiments.
Figure 6:
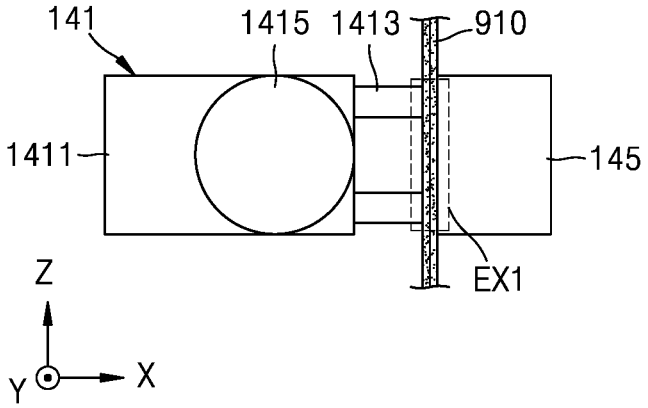
FIG. 6 is a cross-sectional view of a thermosetting unit according to example embodiments.

FIGS. 4 to 6 are diagrams illustrating the thermosetting unit 140 according to example embodiments. FIG. 4 is a perspective view illustrating the thermosetting unit 140, FIG. 5 is a plan view of the thermosetting unit 140, and FIG. 6 is a cross-sectional view of the thermosetting unit 140.

Referring to FIGS. 4 to 6, the heating block 141 may include a heating frame 1411, a heating bar 1415 inserted into the heating frame 1411, and a plurality of heating protrusions 1413 provided on a surface of the heating block 141 facing the elastic pad 145. The heating bar 1415 may include a heating coil 1417 (refer to FIG. 8). The heating coil 1417 may wrap around the heating bar 1415. When power is supplied to the heating coil 1417 of the heating bar 1415, the heating coil 1417 is heated, and then, the plurality of heating protrusions 1413 may be heated. Each of the plurality of heating protrusions 1413 may extend continuously and linearly in the second horizontal direction (Y direction) or in the width direction of the vinyl bag 910 (for example, in the second horizontal direction (Y direction)), and the plurality of heating protrusions 1413 may be spaced apart from each other in the length direction (for example, the vertical direction (Z direction)) of the vinyl bag 910. During the thermosetting process, the plurality of heating protrusions 1413 may apply heat to the vinyl bag 910 interposed between the heating block 141 and the elastic pad 145, respectively, and each of the plurality of heating protrusions 1413 may form a sealing line 930 continuously extending in the second horizontal direction (Y direction) or the width direction of the vinyl bag 910 on the vinyl bag 910. As shown in FIG. 4, the heating block 141 may include two heating protrusions 1413 but is not limited thereto, and the heating block 141 may include three or more heating protrusions 1413 spaced apart in the vertical direction (Z direction).

The elastic pad 145 may provide a surface 1451 (refer to FIG. 7A) that adheres to the plurality of heating protrusions 1413 of the heating block 141 during the thermosetting process. The surface 1451 of the elastic pad 145 may include a plane. The elastic pad 145 may include an elastic material such as rubber. While the thermosetting process is performed, the elastic pad 145 pressed by the plurality of heating protrusions 1413 may be elastically deformed. As the elastic pad 145 is elastically deformed, even when there is an alignment error between the heating block 141 and the elastic pad 145, the vinyl bag 910 interposed between the plurality of heating protrusions 1413 and the elastic pad 145 may be stably fixed.

Figure 7A:
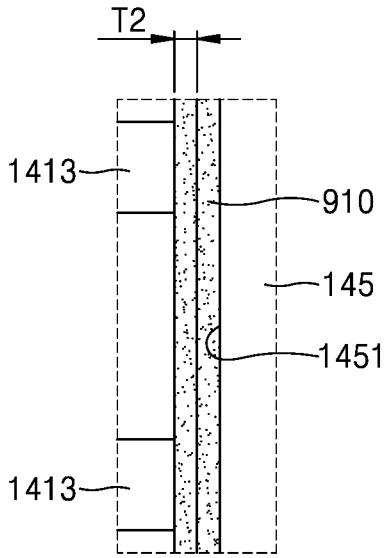
FIGS. 7A and 7B are diagrams illustrating a heat fusion process using a container packaging apparatus according to example embodiments.
Figure 7B:
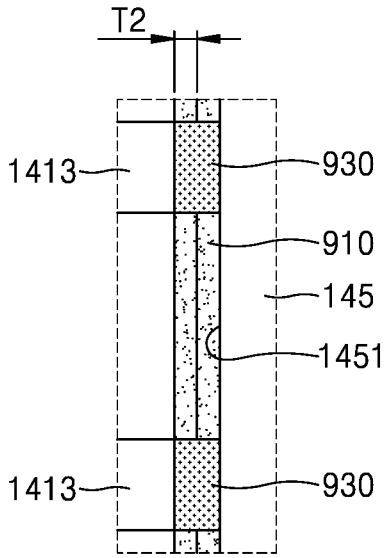

FIGS. 7A and 7B are diagrams illustrating a thermosetting process using the container packaging apparatus 100 according to example embodiments, and FIGS. 7A and 7B are the drawings showing enlarged views of an area indicated by "EX1" in FIG. 6, respectively. Hereinafter, the thermosetting process will be described using the container packaging apparatus 100 with reference to FIGS. 4 to 6 and FIGS. 7A and 7B.

Referring to FIG. 7A, the heating protrusions 1413 and/or the elastic pad 145 are moved so that the plurality of heating protrusions 1413 of the heating block 141 come into close contact with the surface 1451 of the elastic pad 145. As the plurality of heating protrusions 1413 come into close contact with the elastic pad 145, the vinyl bag 910 may be fixed between the plurality of heating protrusions 1413 and the elastic pad 145. For example, the plurality of heating protrusions 1413 may be pressed against the elastic pad 145, and the vinyl bag 910 may be between the plurality of heating protrusions 1413 and the elastic pad 145.

Referring to FIG. 7B, power is supplied to the heating coil 1417 of the heating bar 1415, and heat is applied to the vinyl bag 910 by the plurality of heating protrusions 1413 to form a plurality of sealing lines 930 on the vinyl bags 910. Each heating protrusion 1413 may form one sealing line 930. The plurality of sealing lines 930 may be spaced apart from each other in the vertical direction (Z direction). The plurality of sealing lines 930 may be parallel to one another.

In embodiments, a thickness T2 of the vinyl bag 910 may be in a range from about 0.03 mm to about 0.05 mm. If the thickness T2 of the vinyl bag 910 is less than 0.03 mm, due to gas permeating the vinyl bag 910, a tearing phenomenon in the substrate WF in the container CT due to physical scratches may occur. If the thickness T2 of the vinyl bag 910 is greater than 0.05 mm, the total heating time for the thermosetting process is increased and holes may occur in the vinyl bag 910, thereby reducing the sealing reliability of the vinyl bag 910.

In example embodiments, when the thickness T2 of the vinyl bag 910 is in a range from about 0.03 mm to about 0.05 mm, a thickness T1 of the elastic pad 145 may be in a range from about 3 mm to about 7 mm. Here, the thickness T1 of the elastic pad 145 may denote a length of the elastic pad 145 in a direction perpendicular (for example, in the first horizontal direction (X direction)) to the surface 1451 of the elastic pad 145 in contact with the heating block 141. If the thickness T1 of the elastic pad 145 is less than 3 mm, the uniformity of heat applied to the vinyl bag 910 may decrease, and thus, sealing reliability may be decreased. If the thickness T1 of the elastic pad 145 is greater than 7 mm, the total heating time for the thermosetting process is increased and there may be a problem that the vinyl bag 910 is pierced, and thus, the sealing reliability of the vinyl bag 910 is reduced.

Figure 8:
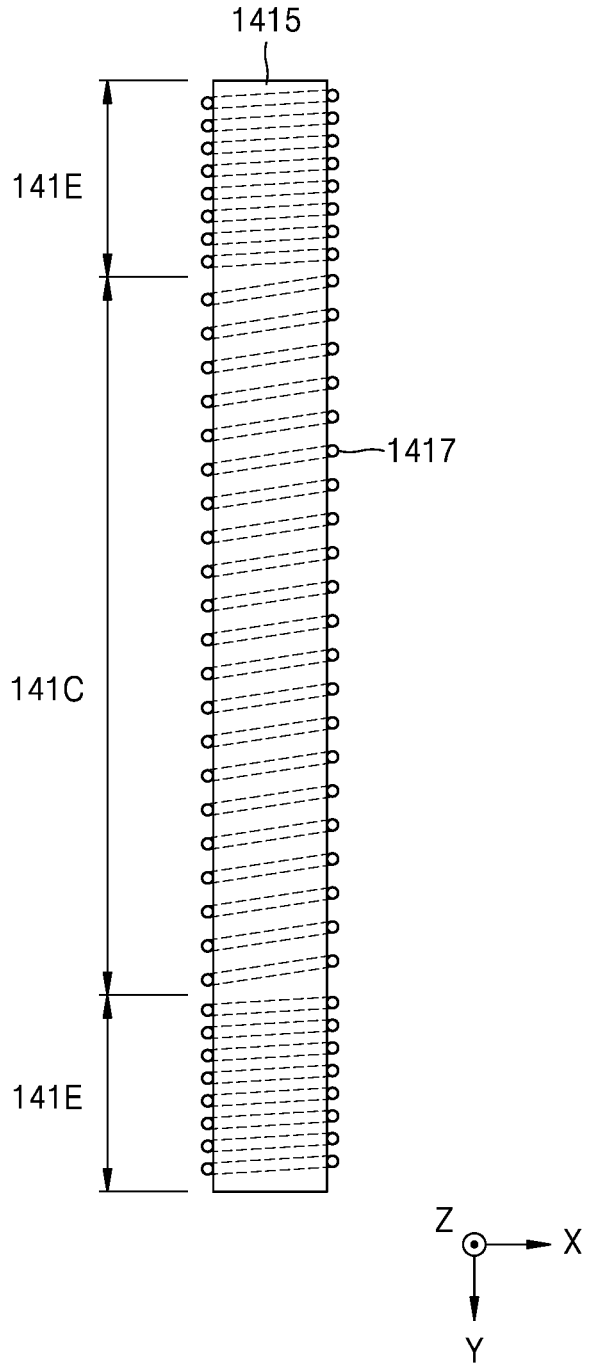
FIG. 8 is a plan view of a heating bar of a heating block according to example embodiments.

FIG. 8 is a plan view of a heating bar 1415 of the heating block 141 according to example embodiments.

Referring to FIG. 8 together with FIGS. 4 to 6, in the heating block 141, the number of windings per unit length of the heating coil 1417 may be different for each region of the heating block 141. The number of windings per unit length of the heating coil 1417 at the edge portion 141E of the heating block 141 (for example, an edge portion of the heating bar 1415) may be greater than the number of windings per unit length at a center portion 141C of the heating block 141 (for example, the heating bar 1415). Here, the heating block 141 has two edge portions 141E spaced apart with the center portion 141C therebetween, and the length of each edge portion 141E in the second horizontal direction (Y direction) may be in a range from about 10% to about 30% of the total length of the heating block 141 in the second horizontal direction (Y direction). In embodiments, the number of windings per unit length at the edge portion 141E of the heating block 141 may be in a range from about 110% to about 150% or in a range from about 120% to about 140% of the number of windings per unit length of the center portion 141C of the heating block 141.

In general, the heat applied to the vinyl bag 910 through the edge portion 141E of the heating block 141 is less than the heat applied to the vinyl bag 910 through the center portion 141C of the heating block 141, and thus, there is a problem in that uniformity of heat applied to the vinyl bag 910 is reduced. However, according to the embodiments, because the number of windings per unit length of the heating coil 1417 at the edge portion 141E of the heating block 141 is greater than the number of windings per unit length of the heating coil 1417 at the center portion 141C of the heating block 141, the uniformity of heat applied to the vinyl bag 910 through the heating block 141 may be improved, and thus the sealing reliability of the vinyl bag 910 may be improved.

Figure 9:
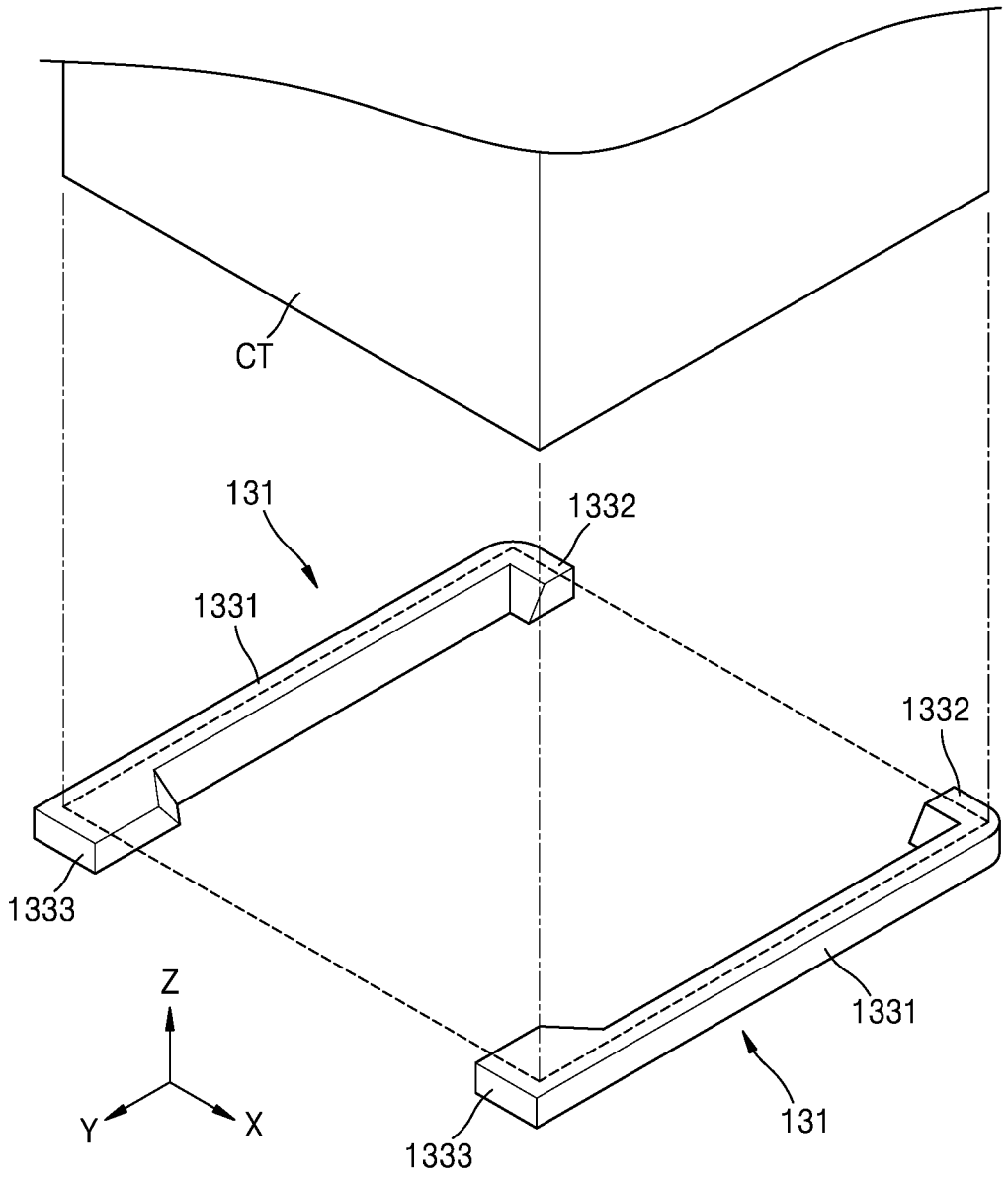
FIG. 9 is a perspective view illustrating a load port according to example embodiments.
Figure 10:
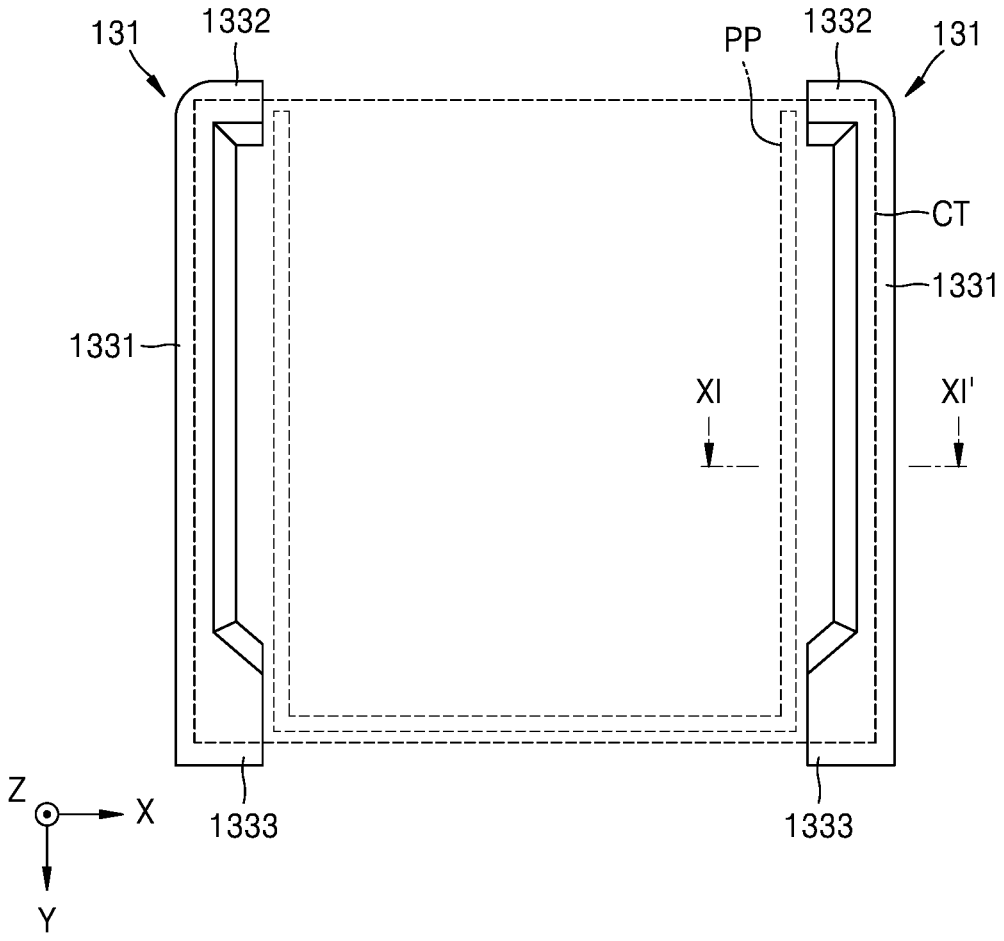
FIG. 10 is a plan view illustrating a load port according to example embodiments.
Figure 11:
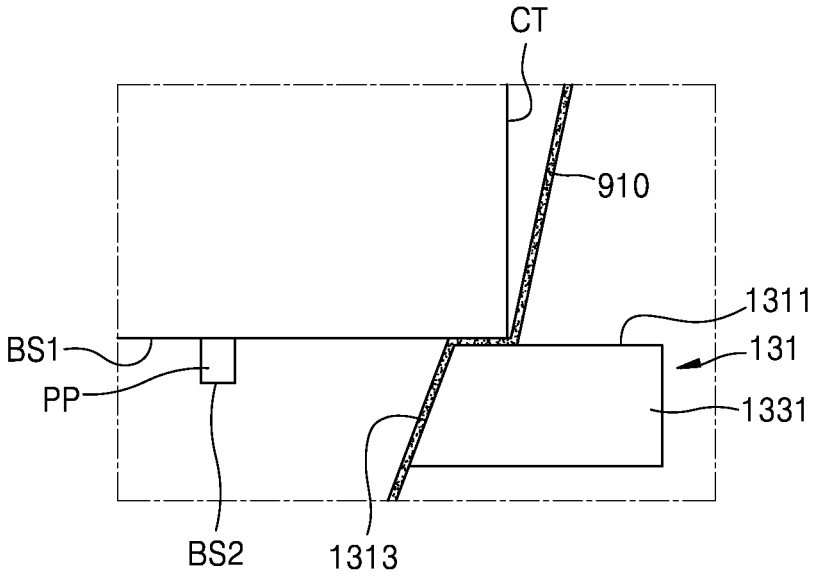
FIG. 11 is a cross-sectional view taken along line XI-XI' of FIG. 10.

FIGS. 9 to 11 are views illustrating a load port 130 according to example embodiments, FIG. 9 is a perspective view showing the load port 130, FIG. 10 shows a plan view of the load port 130, and FIG. 11 is a cross-sectional view taken along line XI-XI' of FIG. 10.

Referring to FIGS. 9 to 11 together with FIG. 1E, the pair of support blocks 131 are spaced apart in the first horizontal direction (X direction), and each of the pair of support blocks 131 may extend in the second horizontal direction (Y direction). One of the pair of support blocks 131 may support one side of the bottom surface of the container CT, and the other of the pair of support blocks 131 may support another side of the bottom surface of the container CT. One side and another side of the bottom surface of the container CT may be spaced apart from each other in the first horizontal direction (X direction). The pair of support blocks 131 may include a mounting surface 1311 that contacts and supports the bottom surface of the container CT and an inclined surface 1313 for guiding the movement of the vinyl bag 910 interposed between the pair of support blocks 131 and the container CT. In the pair of support blocks 131, the mounting surface 1311 may include a plane perpendicular to the vertical direction (Z direction), and the inclined surface 1313 may obliquely extend inwardly with respect to the mounting surface 1311.

In some embodiments, the pair of support blocks 131 may include a front block 1332, a rear block 1333, and a connection block 1331 extended in the second horizontal direction (Y direction) between the front block 1332 and the rear block 1333. The front block 1332, the rear block 1333, and the connection block 1331 form one body and may have the same material composition.

The front block 1332 may extend from one end of the connection block 1331 to a direction bent with respect to the extension direction of the connection block 1331, and the rear block 1333 may extend from another end of the connection block 1331 in a direction bent with respect to the extension direction of the connection block 1331. A length of the front block 1332 in the first horizontal direction (X direction) and a length of the rear block 1333 in the first horizontal direction (X direction) respectively may be greater than a length of the connection block 1331 in the first horizontal direction (X direction). In a plane view, the pair of support blocks 131 may have a groove defined by sides of the front block 1332, sides of the connection block 1331, and sides of the rear block 1333.

In some embodiments, the bottom surface of the container CT may include a protrusion PP, and the bottom surface of the container CT may have a first surface BS1 and a second surface BS2 at different vertical levels. The second surface BS2 is a surface of the protrusion PP and may be lower than the first surface BS1. The pair of support blocks 131 may be spaced apart from the protrusion PP and support the first surface BS1 of the container CT in the vicinity of the protrusion PP. That is, in each of the pair of support blocks 131, the front block 1332, the connection block 1331, and the rear block 1333 contact and support the first surface BS1 of the container CT but do not contact with the second surface BS2 of the container CT. The first surface BS1 of the container CT may include a plane parallel to the mounting surface 1311 of each support block 131. A portion of the first surface BS1 of the container CT that contacts the mounting surface 1311 of each support block 131 may be flat as a whole. If the pair of support blocks 131 contact with the protrusion PP on the bottom surface of the container CT, a load may concentrate between the pair of support blocks 131 and the protrusion PP on the bottom surface of the container CT, and thus, the vinyl bag 910 may be torn. However, according to embodiments, because the pair of support blocks 131 may support the container CT by avoiding the protrusion PP on the bottom surface of the container CT, the tearing of the vinyl bag 910 may be reduced.

According to embodiments, the container packaging using a vinyl bag may be automatically implemented by a container packaging apparatus.

According to embodiments, it is possible to reduce physical damage such as tearing or puncture in a vinyl bag in the process of packaging a container with the vinyl bag, thereby improving the reliability of container packaging using a vinyl bag. Accordingly, the exposure of a substrate in the container to the external environment is blocked during transport of the container, and thus, contamination of the substrate may be prevented and accordingly, the reliability of a semiconductor device manufactured using the substrate may be improved.

While the inventive concept has been particularly shown and described with reference to embodiments thereof, it will be understood that various changes in form and details may be made therein without departing from the spirit and scope of the following claims.

What is claimed is:

1. A container packaging apparatus comprising:

a moving table supporting a container;

a bag supply unit configured to supply a vinyl bag to cover the container on the moving table, wherein the vinyl bag has an upper part that is sealed and a lower part that is opened;

a load port including a pair of support blocks that support a bottom surface of the container transferred from the moving table and are spaced apart with a gap through which the vinyl bag passes; and a thermosetting unit configured to form a sealing line on the lower part of the vinyl bag to seal the vinyl bag, the thermosetting unit including a heating block having a heating coil and an elastic pad in contact with the heating block while the vinyl bag is heated by the heating block, wherein a number of windings per unit length of the heating coil at an edge of the heating block is greater than a number of windings per unit length of the heating coil at a center of the heating block, wherein a thickness of the vinyl bag is in a range from about 0.03 mm to about 0.05 mm, wherein a thickness of the elastic pad is in a range from about 3 mm to about 7 mm, and wherein the pair of support blocks respectively support one side and another side of the bottom surface of the container.

2. The container packaging apparatus of claim 1, wherein the heating block includes a plurality of heating protrusions configured to apply heat to the vinyl bag interposed between the elastic pad and the heating block, and wherein each of the plurality of heating protrusions continuously extends in a width direction of the vinyl bag.

3. The container packaging apparatus of claim 2, wherein a surface of the elastic pad contacting the plurality of heating protrusions includes a flat surface.

4. The container packaging apparatus of claim 2, wherein a distance between the heating block and the elastic pad in a first direction is adjusted by moving at least one of the heating block and the elastic pad.

5. The container packaging apparatus of claim 1, wherein the number of windings per unit length of the heating coil at the edge of the heating block is in a range from about 110% to about 150% of the number of windings per unit length of the heating coil at the center of the heating block.

6. The container packaging apparatus of claim 1, wherein the pair of support blocks include ultra-high molecular weight polyethylene.

7. The container packaging apparatus of claim 1, wherein each of the pair of support blocks is a single piece.

8. The container packaging apparatus of claim 7, wherein each of the pair of support blocks includes:

a connection block;

a front block extending from one end of the connection block in a direction bent with respect to an extension direction of the connection block; and a rear block extending from another end of the connection block in a direction bent with respect to the extension direction of the connection block.

9. The container packaging apparatus of claim 8, wherein the bottom surface of the container includes a protrusion, and wherein the front block and the rear block are spaced apart from the protrusion.

10. The container packaging apparatus of claim 7, wherein the pair of support blocks have a shape symmetrical to each other.

11. The container packaging apparatus of claim 1, wherein the bag supply unit includes:

a supply roll configured to supply vinyl fabric;

a holder including a plurality of holding blocks configured to hold an end of the vinyl fabric and configured to move the vinyl fabric; and a cutter configured to cut the vinyl fabric to separate the vinyl bag from the vinyl fabric.

12. The container packaging apparatus of claim 1, wherein a part of the bottom surface of the container in contact with the moving table does not overlap with parts of the bottom surface of the container in contact with the pair of support blocks.

13. A container packaging apparatus comprising:

a load port including a pair of support blocks that support a container covered with a vinyl bag and are spaced apart from each other with a gap through which the vinyl bag passes; and a thermosetting unit configured to form a sealing line under the vinyl bag and including a heating block having a heating coil and an elastic pad contacting the heating block while the vinyl bag is heated by the heating block, wherein a number of windings per unit length of the heating coil at an edge of the heating block is greater than a number of windings per unit length of the heating coil at a center of the heating block, wherein the pair of support blocks respectively support one side and another side of a bottom surface of the container, and wherein the pair of support blocks are each a single piece.

14. The container packaging apparatus of claim 13, wherein a distance between the heating block and the elastic pad in a first direction is adjusted by a movement of at least one of the heating block and the elastic pad, and wherein a thickness of the elastic pad in the first direction is in a range from about 3 mm to about 7 mm.

15. The container packaging apparatus of claim 14, wherein the heating block includes two heating protrusions configured to apply heat to the vinyl bag interposed between the elastic pad and the heating block, wherein the two heating protrusions each extend in a second direction perpendicular to the first direction, and wherein the two heating protrusions are spaced apart in a third direction perpendicular to the first and second directions.

16. The container packaging apparatus of claim 13, wherein the bottom surface of the container includes a protrusion, wherein the pair of support blocks include a mounting surface in contact with the bottom surface of the container, and wherein the pair of support blocks are spaced apart from the protrusion on the bottom surface of the container.

17. The container packaging apparatus of claim 16, wherein each of the pair of support blocks includes:

a connection block;

a front block extending from one end of the connection block in a direction bent with respect to an extension direction of the connection block; and a rear block extending from another end of the connection block in a direction bent with respect to the extension direction of the connection block.

* * * * *